US012728963B2

(12) United States Patent
Norrie

(10) Patent No.: US 12,728,963 B2
(45) Date of Patent: Sep. 8, 2026

(54) WATERCRAFT LEASH CONSTRUCTION

(71) Applicant: Fin Control Systems Pty. Limited, Coffs Harbour (AU)

(72) Inventor: Scott Norrie, Coffs Harbour (AU)

(73) Assignee: Fin Control Systems Pty. Limited, Mona Vale (AU)

( * ) Notice: Subject to any disclaimer, the term of this patent is extended or adjusted under 35 U.S.C. 154(b) by 379 days.

(21) Appl. No.: 18/253,267

(22) PCT Filed: Aug. 25, 2021

(86) PCT No.: PCT/AU2021/050971
§ 371 (c)(1),
(2) Date: May 17, 2023

(87) PCT Pub. No.: WO2022/104407
PCT Pub. Date: May 27, 2022

(65) Prior Publication Data

US 2023/0406456 A1 Dec. 21, 2023

(30) Foreign Application Priority Data

Nov. 17, 2020 (AU) ..... 2020904236

(51) Int. Cl.
*B63B 32/73* (2020.01)
*D07B 1/02* (2006.01)

(52) U.S. Cl.
CPC ..... *B63B 32/73* (2020.02); *D07B 1/02* (2013.01); *D07B 2201/1012* (2013.01); *D07B 2201/2069* (2013.01); *D07B 2205/2003* (2013.01); *D07B 2401/2005* (2013.01)

(58) Field of Classification Search
CPC ..... B63B 32/73; B63B 2205/00; D07B 1/02; D07B 2201/1012; D07B 2201/2069; D07B 2205/2003; D07B 2401/2005
See application file for complete search history.

(56) References Cited

U.S. PATENT DOCUMENTS 2,117,322 A * 5/1938 Hillman ..... A01K 91/00 43/42.72
3,931,656 A * 1/1976 Thomson ..... B63B 32/70 441/75
4,044,415 A * 8/1977 Wood ..... B63B 32/73 441/75
4,694,541 A * 9/1987 Skyba ..... F16G 11/12 24/301
7,918,699 B2 * 4/2011 Malloy ..... B63B 32/77 441/75

(Continued)

FOREIGN PATENT DOCUMENTS

CN 107836371 B 6/2020
JP S4889946 A 11/1973

(Continued)

*Primary Examiner* — Joshua E Freeman
(74) *Attorney, Agent, or Firm* — WCF IP

(57) ABSTRACT

A watercraft leash assembly has a leash cord construction comprising an elongate, elastomeric cord body having a reinforcing element embedded therein. The reinforcing element may comprise a co-extruded filament which is helical or other non-linear shape when the leash cord is in a non-extended condition, and which straightens as the leash cord extends.

12 Claims, 3 Drawing Sheets

(56) References Cited

U.S. PATENT DOCUMENTS

| | | | | |
|---|---|---|---|---|
| 8,894,457 | B1 * | 11/2014 | Crozier | B63B 32/70 441/75 |
| 9,067,654 | B2 * | 6/2015 | Lessing | B63B 32/70 |
| 9,580,154 | B2 * | 2/2017 | Falken | B63B 32/73 |
| 9,675,137 | B2 * | 6/2017 | Wu | A43C 9/00 |
| 11,339,512 | B2 * | 5/2022 | Kajiwara | D04C 1/12 |
| 11,701,125 | B2 * | 7/2023 | Haskins | B63B 32/73 606/203 |
| 2010/0133306 | A1 * | 6/2010 | Monroe | B63B 32/73 224/267 |
| 2013/0023170 | A1 | 1/2013 | Buche | |
| 2014/0127957 | A1 * | 5/2014 | Buche | B63B 32/73 441/75 |
| 2014/0357140 | A1 * | 12/2014 | Falken | B29C 65/00 441/75 |
| 2015/0274265 | A1 * | 10/2015 | Falken | B63B 32/73 441/75 |
| 2019/0106839 | A1 * | 4/2019 | Norrie | D07B 1/02 |
| 2019/0144085 | A1 * | 5/2019 | Ventura | B63B 32/73 441/75 |
| 2021/0123172 | A1 * | 4/2021 | Kajiwara | D04C 1/02 |
| 2023/0018353 | A1 * | 1/2023 | Montague | B63B 32/73 |

FOREIGN PATENT DOCUMENTS

| | | | | |
|---|---|---|---|---|
| JP | S59197263 | A | | 11/1984 |
| JP | H02169788 | A | * | 6/1990 |

* cited by examiner

WATERCRAFT LEASH CONSTRUCTION

BACKGROUND OF THE INVENTION

1. Field of the Invention

The present invention relates to leashes for watercraft used for surfing and other water sports such as body-boarding and stand-up paddle boarding. More specifically, the present invention relates to a cord construction that may be used within a leash assembly.

2. Description of the Art

There are various known arrangements and constructions for watercraft leashes. Watercraft may include surfboards, body boards, kiteboards and stand-up paddle boards (SUP) for example. A leash is secured at one end to the watercraft user and at the other end to the watercraft as described below, securing the watercraft to the user in the event that the user is dislodged from the watercraft when using it.

Surfboard leashes have become invaluable surfing equipment and the predominant method of tethering the surfboard or other watercraft to the surfer or watercraft user. By connecting the surfboard to the surfer, the watercraft user may experience many benefits; perhaps the most important of which being enhanced safety in the surf. A surfboard leash enables the surfer to be connected to the surfboard in the event of dismounting from the surfboard or experiencing a "wipe-out". In doing so, the surfer is not left stranded without a flotation device in dangerous conditions which may be a significant distance from the shoreline. By facilitating the ability to quickly retrieve the surfboard after a wipe-out, the surfboard leash permits more time surfing and less time recovering the surfboard. It is also generally recognised that a surfboard leash may improve the safety of all surfers in the vicinity of the watercraft user by reducing the unrestricted movement of the surfboard or other watercraft, leading to less chance of surfboard damage, injury and drowning.

Conventional surfboard leashes are generally constructed with a cuff (or "ankle strap") connected to an elongated cord, for example typically of extruded Thermoplastic Polyurethane (TPU).

The cuff generally secures about an ankle of the surfer, typically using a hook and loop fabric fastener arrangement. Each end of the TPU cord is normally over-moulded with an end piece to mate with a swivel assembly that is housed within the cuff (on one end of the leash) and within a webbing strap, or "rail-saver" (at the other end of the leash) for connection to the surfboard. Both the cuff and the rail saver strap are generally constructed from Polypropylene/Polyester/Nylon webbing, neoprene and hook and loop fasteners using "cut-and-sew" manufacturing.

Similar leashes may also be used for other watercraft and their users. For example, for body boards the cuff may be configured to be secured about the bicep or wrist of the body-board user. While users for SUPs may have the leash configured to be attached to the user's ankle.

TPU has traditionally been a suitable material for surf leash cords due to the combination of good strength and shock-absorbing properties at an acceptable cord thickness/diameter with respect to hydrodynamic drag and weight without exhibiting the high recoil or highly elastic properties of natural rubber, for example as used for bungee cords or shock cords. When a surfer dismounts from a surfboard, wave/s can exert a significant force on the surfboard and the surf leash. To withstand these forces, it is necessary to select the appropriate TPU cord thickness for the prevailing surf conditions; thinner TPU cords (typically around 5 mm diameter) may mostly resist breakage on smaller waves, whilst thicker TPU cords (typically around 10 mm diameter) may usually resist breakage on larger waves. Leash cords with greater thickness create more hydrodynamic drag and weight; therefore the selection of thicker leash cords is normally restricted to larger wave conditions otherwise surfing performance may be adversely affected. Regardless of leash cord thickness, in order to absorb the shock transferred from wave to the surfer's ankle, it is desirable for a leash to provide dampening stretch. That is, the leash stretches so that force is applied to the user's ankle gradually as the leash cord elongates.

Typical TPU leash cords have an ultimate strength mostly determined by the TPU cord thickness/diameter. In order to construct a thinner leash cord from the same TPU (with lower weight and drag) it is necessary to reduce ultimate strength of the TPU cord and the higher, consequent likelihood of breakage or fracture of the cord. This reduction in cord diameter versus improved surfing performance may be an unacceptable compromise as this can result in the leash cord breaking prematurely and thus untethering the surfboard from surfer and increasing risk of injury and/or damage. It is desirable to have increased comfort and performance of the leash during surfing by a reduction in the thickness, weight and hydrodynamic drag of a surf leash cord without reducing the ultimate strength or shock absorption properties of the leash.

It is desirable for a surf leash cord to be as unobtrusive and tangle-free as possible in the water when paddling, sitting/waiting on the surfboard and when standing up surfing waves. Like any cord, existing TPU leash cords can be susceptible to tangling, which can be a frustrating, disruptive experience in the surf where performance and safety can suffer and untangling is necessitated. A longer leash length will increase the chances of tangling. The most common surf leash cord lengths are slightly longer than surfboard length. For example for many common short boards the leash may be 150 to 210 cm long (5-7 foot long) or even longer for modern longboards and SUPs. Similarly, a typical TPU leash that has experienced deformation (e.g. from creep when stress is held constant during shipping or storage, overstretching during use or other forces) is likely to feature kinks or inconsistencies along the direction of the length of the cord which may result in more irregular, less anticipated movement during use and thus increasing the chance of tangling. For example looping of the TPU about itself and/or the limbs of the watercraft user.

Whilst it is necessary for the TPU to stretch somewhat in order to provide shock-dampening, if the TPU leash cord stretches too much beyond the elastic limit the material will plastically deform. This results in the common problem of a leash "over-stretching" where a leash is permanently deformed or stretched beyond the original length. This may occur in use when the leash experiences a force beyond the elastic limit of the TPU cord, from say larger waves and/or a particularly vigorous wipe-out. It is not uncommon for TPU leash cords that have been repeatedly over-stretched in use to be permanently deformed to 2 or 3 times the original length of the leash cord. Not only is an over-stretched cord longer and more susceptible to tangling and interference during surfing and other watercraft use, the over-stretched cord also becomes thinner and weaker and thus reducing ultimate strength.

Typically TPU surf leash cords are constructed as one single extruded/moulded part with limited cut or abrasion resistance. Accordingly TPU leashes may be prone to damage and/or breakage during use. If the cord is damaged or cut during usage (such as abrasive and cutting interactions with rocks, reef, surf fins, tangling with persons or objects) then subsequent stretching may then propagate the damage/cut through the thickness of the cord and consequently reduce the ultimate strength of the leash. As a homogenous part, the traditional TPU surf leash cord is susceptible to a single failure mode whereby when the cord is damaged it is reliant upon resisting the propagation of the damage or fracture through the thickness of the cord. Accordingly such leashes are prone to catastrophic failure where hard to see nicks or cuts to the TPU cord may remain undetected until they fail in use.

WO2017181225 discloses a leash assembly with a nylon overbraiding which limits extension of the cord, and providing improvements in strength and tangling.

US2014357140 describes a leash cord including a central elastic fibre rope down the centre of the cord.

However, none of these prior art apparatus, assemblies and methods provides an entirely satisfactory solution to the provision of a leash for a watercraft in a wide range of wave conditions.

Any reference herein to known prior art does not, unless the contrary indication appears, constitute an admission that such prior art is commonly known by those skilled in the art to which the invention relates, at the priority date of this application.

SUMMARY OF THE INVENTION

The present invention aims to provide an alternative leash arrangement, assembly and/or method which overcomes or ameliorates the disadvantages of the prior art, or at least provides a useful choice.

In one form the invention provides a watercraft leash comprising:

- a first end having a first end connector portion for securing to a watercraft,
- a second end having a second end connector portion for securing to a watercraft user,
- a leash cord extending generally from the first end to the second end of the leash,
- the leash cord comprising an elongate, elastomeric cord body having a non-linear filament embedded therein, said filament being non-linear when the leash cord is in a non-extended condition, and which becomes more straight as the leash cord extends.

The non-linear filament may thus act as a reinforcing element for the leash cord.

In one example embodiment, the material of the reinforcing element has a higher elastic modulus than the cord body material. Preferably, the reinforcing element straightens with extension of the cord body under tensile force.

In one example form, the leash cord may have a first stress-strain ratio during initial stretching from the non-extended condition when the reinforcing element is substantially non-linear, and a second, higher stress-strain ratio when the leash cord is in an extended condition whereby the reinforcing element approaches the linear The non-linear reinforcing filament when the leash cord is in its non-extended condition may have a regular repeating shape, for example selected from helical, sinuous, or zigzag. Helical is preferred.

In one preferred form, the reinforcing element is a single strand helical filament, which may be co-extruded with the elastomeric cord body. Both the cord body may be formed of TPU materials, preferably of different properties.

In one example, the reinforcing element has a regular repeating shape having a pitch selected from the range from 6 to 30 mm, for example 6-20 mm, 8-16 mm, 10-14 mm, 11-13 mm, or about 10, 11, 12, 13, or 14 mm.

If the regular repeating shape of the filament is a helix, the diameter of the helix—that is, the amplitude of the helix in side view—may be for example greater than 50% of the external diameter of the cord body, for example about 60%, 70%, 80%, 90%, 90-98%, or about 95.

The cord body may have an external diameter for example of from 4-15 mm, for example 4-11, or 5-10 mm, or about 5, 5.5, 6, 7, 8, 9 or 10 mm diameter. For SUP leashes the cord diameter may be about 7-9 mm, for example about 8 mm.

The leash cord may have a break force of over 50 kg force, and more preferably example over 60 kg, 70 kg, 75 kg, 80 kg, 90 kg or 100 kg.

In an alternative form the invention provides a leash for a watercraft substantially as described herein with respect to the figures.

Further forms of the invention are as set out in the appended claims and as apparent from the description.

DISCLOSURE OF THE INVENTION

BRIEF DESCRIPTION OF THE DRAWINGS

The description is made with reference to the accompanying drawings, of which.

DETAILED DESCRIPTION

An example surfboard or other watercraft leash assembly is described with reference to FIGS. 1 to 3.

Figure 1:
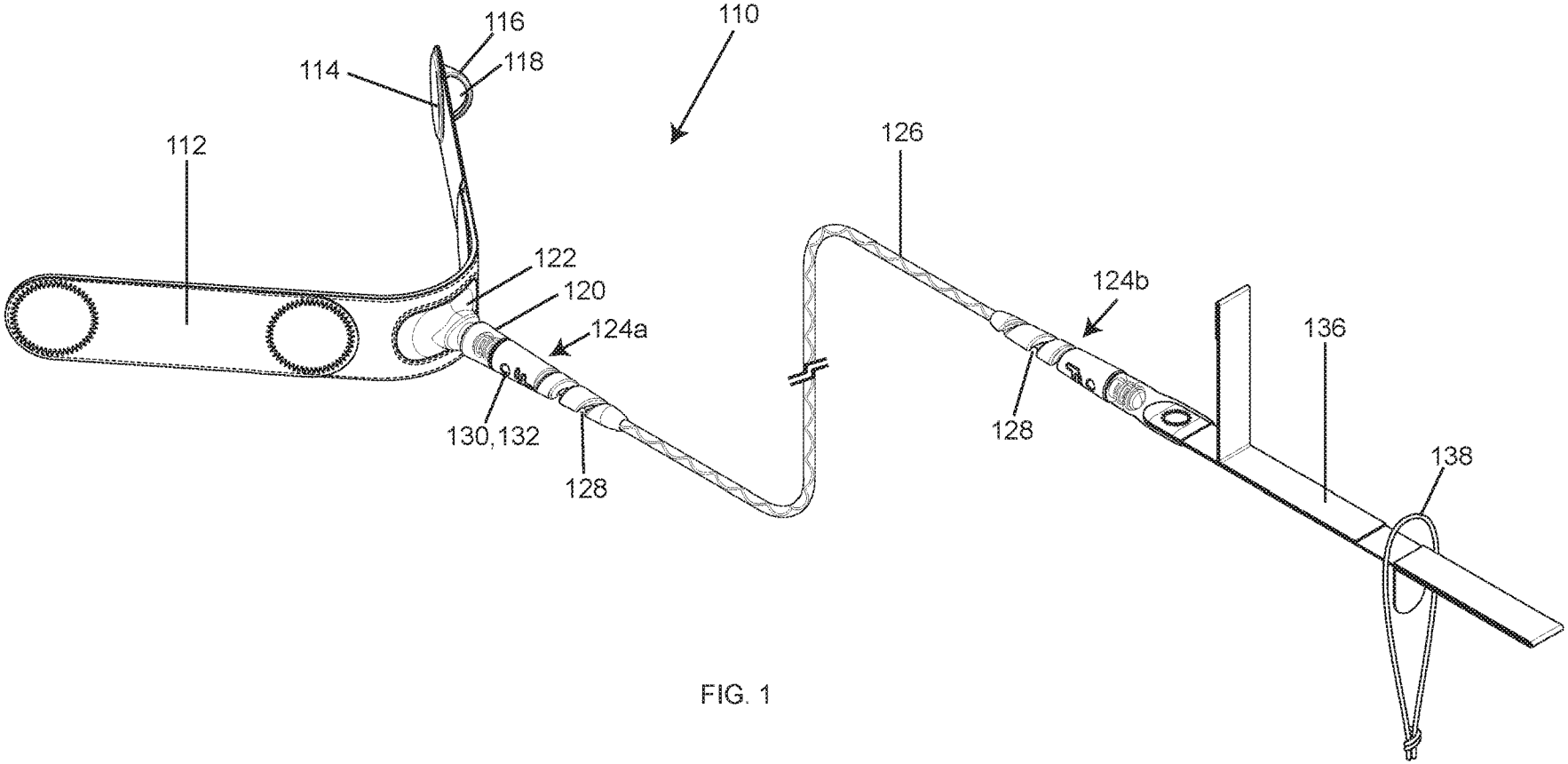
FIG. 1 is a schematic isometric view of a surf leash assembly with a leash cord including a non-linear reinforcing element, according to an example embodiment.

FIG. 1 is a schematic isometric view of a surf or other watercraft leash assembly 110 with an ankle cuff assembly 112 with hook and loop fabric/textile fastening for securing about a limb of the surfer or other watercraft user.

The ankle cuff assembly 112 may have a slip-reducing print or pattern (not shown) on the inside surface 114 of the cuff facing the limb of the watercraft user in use. The cuff 112 may also feature a hydrodynamically shaped pull tab 116 to facilitate fastening and unfastening of the cuff by the user. The pull tab 116 may be used by the watercraft user to undo the cuff by pulling upon the pull tab with a finger inserted into the pull tab aperture 118 or by grasping the erect loop with two fingers.

The ankle cuff assembly 112 has attached to it or includes an outwardly projecting moulded horn 120 extending from a base 122, which is suitably attached to the cuff 116, for example by stitching, adhesives and/or moulding. The base 122 extends circumferentially about the cuff and limb of the watercraft user.

A swivel assembly is inset into the end of the horn and projecting therefrom to form a swivel connection for an enlarged end piece 124 of the leash cord 126.

Figure 2:
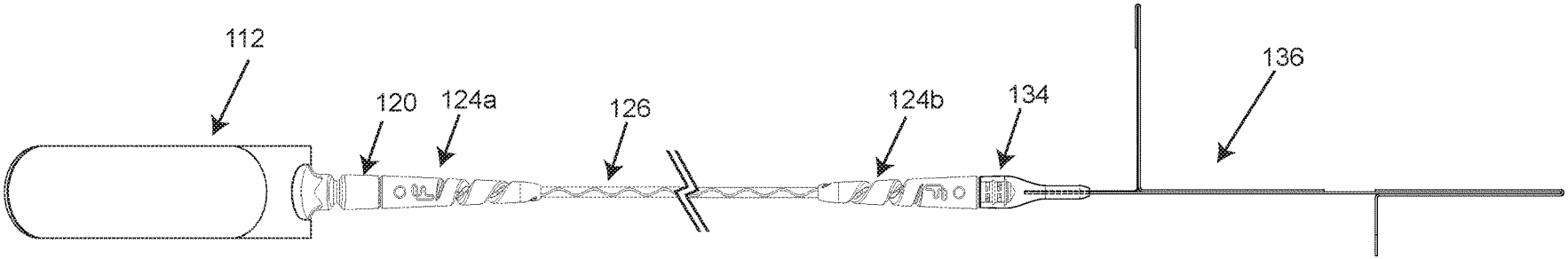
FIG. 2 is a side view of the leash assembly of FIG. 1.

The swivel assembly is obscured in FIGS. 1 and 2, however the swivel assembly and construction and configuration of the cuff may be similar to that described and shown in FIG. 8 of WO2017181225.

The contents of WO2017181225 are incorporated herein by reference.

The base 122 and horn 120 of the cuff, and the end piece 124 of the cord 126 may be constructed of a suitable elastomer/plastics material, for example of TPU, which may be of similar material properties to the cord body material. The swivel assembly may typically be metal, for example a stainless steel with sufficient corrosion resistance to withstand the harsh conditions to which the leash may typically be exposed in use.

The enlarged diameter end piece 124 is attached for example by overmoulding or adhesive to the end of the cord 126, and may include cut out portions 128 to facilitate stretching of the end portion with the section of the cord within the end portion in use, to help prevent breakage. The end piece may also be formed of TPU, for example of similar properties to the cord body The end piece includes a hole 130 receiving a grub screw 132 or similar projecting into the centre cavity of the end piece to engage within a groove in the portion of the swivel which projects from the end of the horn, to provide the swivel connection, this reducing tangling of the leash in use.

At the other end of the leash cord, a further similar end piece 124*b* connects to a further swivel assembly 134 connected to a webbing strap, "rail saver" or securing strap 136 which includes a rope loop 138 for threading through and connecting to a surfboard leash plug. In this way, the leash is attached to the surfboard or other watercraft (not shown) at one end, and to the user at the other end.

The rail saver arrangement and the connection between the cord and the rail saver may be generally similar to that described in WO2017181225.

Figure 3:
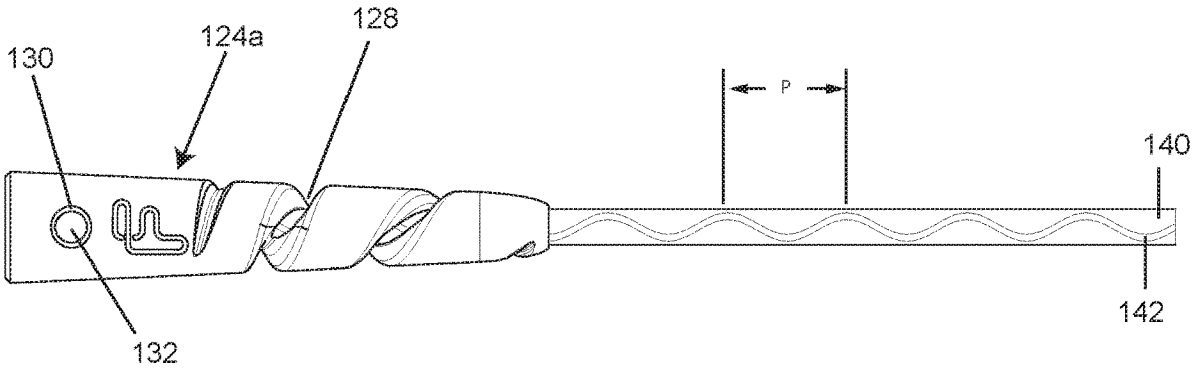
FIG. 3 is a side view detail of an end portion of the leash cord and its end piece, showing the reinforcing element embedded in the leash cord in greater detail.

The construction of the cord 126 is shown in FIGS. 1 to 3, but seen in more detail in FIG. 3.

The cord 126 construction comprises a generally cylindrical, elongate, elastomeric cord body matrix 140 forming the matrix of the cord, with a sinuous reinforcing filament 142 extending throughout the length of the cord. In the illustrated embodiment, the reinforcing filament is helical.

The cord body may be formed of extruded elastomer, for example a thermoplastic polyurethane (TPU), Thermoplastic Elastomers (TPEs) such as Thermoplastic Polyester Elastomers (TPC-ETs), or artificial rubber such as Nitrile Rubber and Natural Rubber with similar properties could conceivably be used (but not preferable). However, TPU is preferred.

Where TPU is used for the extruded cord body matrix and for other moulded portions of the leash, the TPU may contain a percentage of TPU derived from natural/renewable sources such as corn starch and/or castor oil.

A TPU material containing up to about 47% natural material raw material, a tensile strength of about 46 MPa, and density of about 1.2 g/cm$^3$ has been found in initial prototyping to be an appropriate material for the cord body matrix material.

The reinforcing filament 142 formed within and running along the length the cord body may also be formed from TPU, and preferably has a higher elastic modulus and break strength than the TPU of the cord body.

For example, the reinforcing filament may have an elastic modulus and/or break strength approximately 10 to 20% higher than that of the cord body.

In an example embodiment, the filament diameter may be about 1-2 mm, for example about 1.3 mm.

The reinforcing filament may be formed within the cord body by co-extrusion, so that the cord body and reinforcing filament form a composite, with the cord body forming a continuous matrix about filament.

The co-extrusion of the helical TPU reinforcing element within the cylindrical TPU cord body may be formed by means of a spinning machine which houses a rotary internal die for the reinforcing filament which sits within the outer, circular profile extrusion die for the cylindrical cord body matrix. Rotation of the spinning machine as the leash cord is being extruded results in co-extrusion of a helical strand of TPU within the generally cylindrical cord body matrix.

Whilst the cord body is described here as being generally cylindrical, the co-extrusion of the cylindrical cord body matrix with the helical reinforcing filament may result in a slightly raised contour variation in outside diameter of the cord following the helical pattern of the embedded reinforcing element. For example, the outside diameter of the cord may have a regular variation in outside diameter of from 0.2-1.5 mm, more preferably about 0.5-1 mm. Without wishing to be bound by theory, it is believed that having this slight variation from perfect cylindrical shape may in fact provide an improvement in hydrodynamics and reduced drag as the cord trails through the water during use.

The pitch P of the reinforcing filament helix may vary for example from about 6 mm to about 30 mm, for example about 10-15 mm, and may be for example about 12 mm for a 6 mm diameter cord as shown. As shown, the diameter of the helix is less than the diameter of the cord body, so that the filament is not exposed at the surface of the cord and is thus protected against abrasion or damage in the harsh conditions to which the leash will be subjected in use.

As an alternative to co-extrusion, the non-linear reinforcing element may first be manufactured, for example by extrusion or moulding, then forming the cord body matrix to encompass the reinforcing element, for example by over-extruding or overmoulding. However, forming the composite cord by the co-extrusion as described above is preferred.

The performance of the elastic cord body matrix with respect to strength and shock dampening may also be selected by considering an appropriate hardness, described on the Shore A scale, for the material of elastic cord body. TPU may be used as an appropriate elastomer for the cord body matrix material described herein due to the elongation properties and performance within the prescribed or described environment. The environmental factors may include: robustness in salt water, UV resistance, etc. and the like for the use of watercraft. A Shore A hardness range of 80 to 100 is considered appropriate for the leash cord body matrix, providing sufficient shock dampening properties for the performance of the invention. The preferred value of Shore A 95 provided above may be considered an optimum for the illustrated example cord construction. A lower Shore A hardness range elastomer, for example a Shore A hardness range of 20 to 70 which is common in natural rubber bungee cords, is not appropriate because the elongation at lower forces would be too high, providing insufficient shock-dampening and dangerous recoil. Likewise, an elastomer harder than the preferred useful range of approximately Shore A 80 to 100 may not provide enough shock-absorbing elongation, such that the recoil or contraction of the cord transfers too much force directly to the surfer, providing an uncomfortable and potentially dangerous interaction between the returning watercraft and the watercraft user. For example, a hardness greater than Shore D 60 for the cord body matrix may be unsuitable for use. It will be readily appreciated that other elasticity related properties to hardness may also be used to define and specify the desired performance and selection of the elastic core material.

Figure 4:
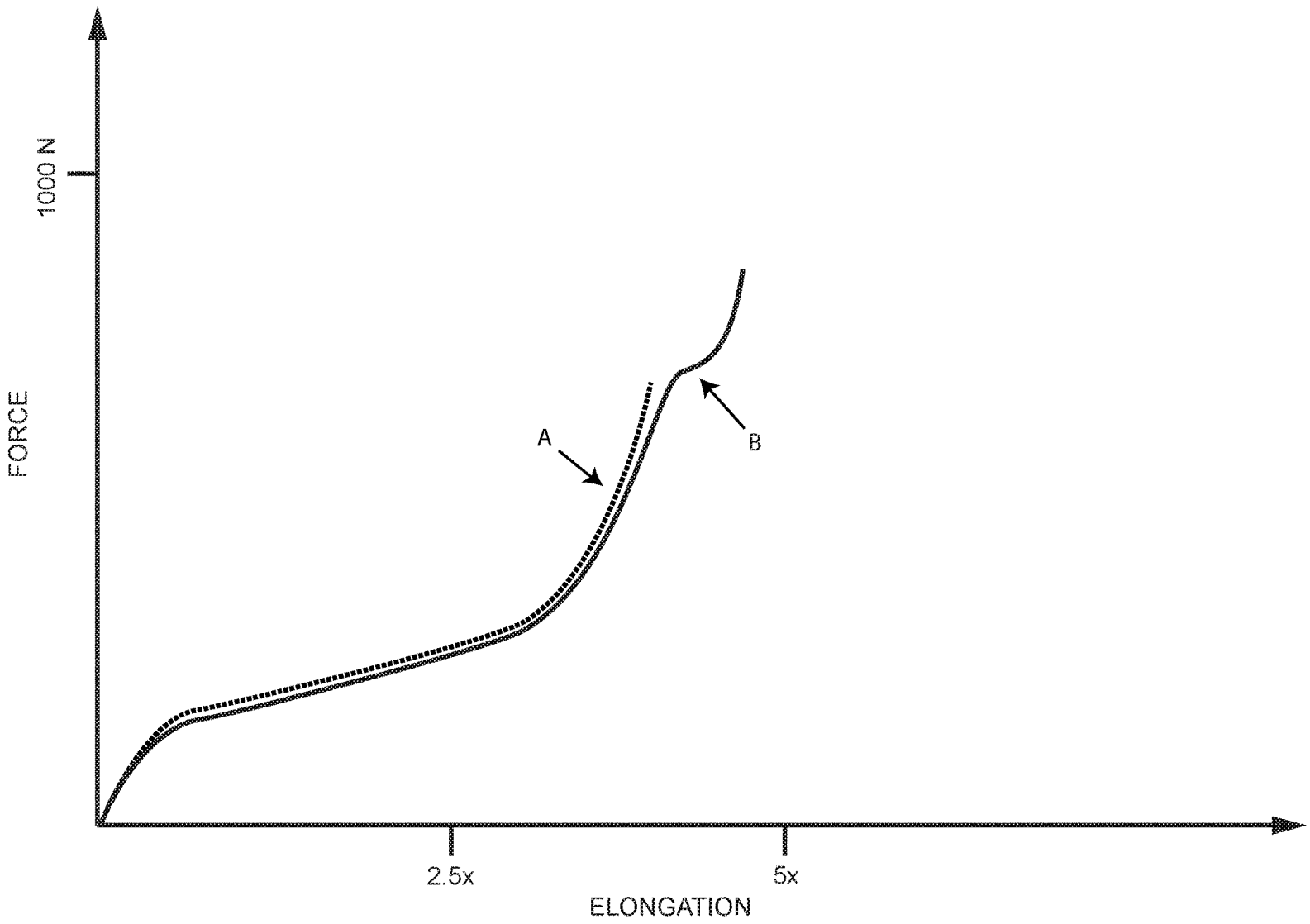
FIG. 4 is a schematic of an example force-elongation (stress-strain) graph of an example stress-strain profile of a leash cord assembly according to an embodiment of the invention, compared to a typical prior art TPU leash cord.

FIG. 4 is a schematic diagram of a tensile force versus elongation graph for a prior art, TPU leash cord, and a TPU leash cord incorporating a non-linear reinforcing filament according to the invention described herein. The origin of the graph corresponds to zero force and the original length of the leash. The elongation has been normalised to the original length of each leash cord, accordingly the 5× elongation on the x axis corresponds to a leash cord which has been elongated to five times its original length.

Each of the two leash cords were tested to the fracture point of the cord. FIG. 4 contrasts typical results for a prior art TPU leash cord and the composite reinforced cord of the invention.

The results for a traditional TPU leash cord are labelled as A. The results for the leash cord with the helical reinforcing filament core are labelled B.

As apparent from FIG. 4, the initial response of both cords to application of elongation force is similar, as the force is taken up initially by elastic stretching of the cord body matrix. The reinforcing filament, being initially helical or other non-linear shape, begins to straighten out by mechanical elongation of the helix shape as the cord body stretches but does not greatly contribute to the force-elongation properties of the leash cord at that part of the curve. Thus the desirable force-dampening properties of the leash cord body are substantially retained as the leash stretches, at least initially, in a first behaviour without an abrupt force on the user as the board is swept away and reached the end of the leash length.

However, as the leash stretches further and cord body approaches and reaches its breaking point, it can be seen from FIG. 4 that the reinforcing filament becomes the dominant factor in performance of the leash beyond that point in a second behaviour, providing a substantial increase in break strength of the leash and reducing the occurrence of leash cord breakage.

As the cord body reached breaking/plastic deformation point—corresponding to the extremity of line A—it is seen that there is initially an inflection in curve B believed to correspond to the remaining straightening of the helical reinforcing filament, then an upwards inflection as the straightened filament acts in substantially elastic mode with high elastic modulus.

Thus it is believed that the described leash cord construction may provide an improved combination of force-dampening and break strength compared to traditional TPU leash cords.

It will be readily appreciated that most if not all the geometries and dimensions of the components of the watercraft leash assembly invention described herein may be scaled up or down to better cater for the intended end user, the size and weight of the watercraft and/or specific surf conditions. For example, the components may be scaled down to further reduce the weight of the leash assembly for conditions that may withstand a reduction in strength such as small waves or surf competition. Conversely, the components may be scaled up or otherwise adjusted for greater strength in big wave conditions. Also, the components may be slightly modified in geometry to produce better sizing and fit for particular target markets such as male adult, women, children and athletes of watercraft users.

In this specification, terms denoting direction, such as vertical, up, down, left, right etc. or rotation, should be taken to refer to the directions or rotations relative to the corresponding drawing rather than to absolute directions or rotations unless the context require otherwise.

Although the invention has been herein shown and described in what is conceived to be the most practical and preferred embodiments, it is recognized that departures can be made within the scope of the invention, which are not to be limited to the details described herein but are to be accorded the full scope of the appended claims so as to embrace any and all equivalent assemblies, devices, apparatus, articles, compositions, methods, processes and techniques.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise, comprised and comprises" where they appear.

REFERENCE SIGNS LIST

| Reference Item | Description |
|---|---|
| 110 | Leash Assembly |
| 112 | Ankle cuff assembly |
| 114 | Inside surface of the cuff |
| 116 | Pull tab |
| 118 | Pull tab aperture |
| 120 | Horn |
| 122 | Base |
| 124a, 124b | Cord end piece |
| 126 | Leash cord |
| 128 | Cut out portions |
| 130 | Hole in end piece |
| 132 | Grub screw |
| 134 | Further swivel assembly |
| 136 | Rail saver |
| 138 | Rope loop |
| 140 | Leash cord body matrix |
| 142 | Helical reinforcing filament |

The invention claimed is:

1. A watercraft leash, comprising:

a first end having a first end connector portion for securing to a watercraft;

a second end having a second end connector portion for securing to a watercraft user; and a leash cord extending generally from the first end to the second end of the leash, the leash cord comprising an elongate, elastomeric cord body having a non-linear filament embedded therein, the filament being non-linear when the leash cord is in a non-extended condition, and straightening as the leash cord extends, wherein the non-linear filament has a helical shape when the leash cord is in its non-extended condition.

2. A watercraft leash according to claim 1, wherein the non-linear filament acts as a reinforcing element for the leash cord.

3. A watercraft leash according to claim 1, wherein the non-linear filament straightens with extension of the cord body under tensile force.

4. A watercraft leash according to claim 1, wherein the leash cord has a first stress-strain characteristic during initial stretching from the non-extended condition when the non-linear filament is substantially non-linear, and a second stress-strain characteristic when the leash cord is in an extended condition whereby the non-linear filament approaches the linear.

5. A watercraft leash according to claim 4, wherein the first stress-strain characteristic is predominantly determined by the stress-strain properties of the cord body up to approximately breaking point of the cord body.

6. A watercraft leash according to claim 1, wherein the helical shape has a helix diameter greater than 50% of an outer diameter of the cord body.

7. A watercraft leash according to claim 1, wherein the helical shape has a pitch selected from one of: the range of 6-30 mm, 6-20 mm, 8-16 mm, 10-14 mm, or 11-13 mm, or about 10, 11, 12, 13, or 14 mm.

8. A watercraft leash according to claim 7, wherein the pitch is from 11 to 13 mm.

9. A watercraft leash according to claim 1, wherein the cord body has an outer diameter selected from one of: the range of 4-11 mm or 5-10 mm, or about 5, 5.5, 6, 7, 8, 9 or 10 mm.

10. A watercraft leash according to claim 1, wherein the non-linear filament is a single strand filament, which is co-extruded with the elastomeric cord body.

11. A watercraft leash according to claim 10, wherein the single strand filament has a filament diameter of 1 to 2 mm.

12. A watercraft leash according to claim 1, wherein the material of the non-linear filament has a higher elastic modulus than the cord body material.

* * * * *